US005477431A

United States Patent [19]

Curameng, Jr.

[11] Patent Number: 5,477,431

[45] Date of Patent: Dec. 19, 1995

[54] SNUBBER ROD

[76] Inventor: Max Curameng, Jr., 160 Academy Dr., Newbury Park, Calif. 91320-1102

[21] Appl. No.: 377,266

[22] Filed: Feb. 24, 1995

[51] Int. Cl.[6] ..... A45B 3/02

[52] U.S. Cl. ..... 362/102; 362/116; 135/16; 135/910

[58] Field of Search ..... 119/801; 135/16, 135/17, 66, 910, 25.41; 362/102, 109, 116; 273/84 R

[56] References Cited

U.S. PATENT DOCUMENTS 4,860,776 8/1989 McQuain ..... 135/16 X 4,962,779 10/1990 Meng ..... 135/16

5,065,904 11/1991 McCaffrey et al. ..... 135/19.5 X

*Primary Examiner*—Stephen F. Husar

*Attorney, Agent, or Firm*—Terrance L. Siemens

[57] ABSTRACT

A personal protective device especially suited for repelling a dog from attacking a pedestrian. The device comprises a tubular holder and an expansible guard stored inside the holder. A spring urges the guard from the holder, into the expanded state. A control button releases the guard to deploy on demand. When deployed, the guard opens into a generally conical configuration, which the user maneuvers over the snout of the animal. The protective device discourages the animal by intimidation, and does not injure the animal. The device further includes a flashlight, key storage, an audible alarm, and a holding ring.

15 Claims, 2 Drawing Sheets

SNUBBER ROD

BACKGROUND OF THE INVENTION

1. Field of the Invention

The present invention relates to a snubber rod for protecting a pedestrian from an attack by a dog. The rod has a member which expands radially when released from the end of the rod. The expanded member partially surrounds the head of the attacking dog, thus thwarting attempts by the dog to bite the user of the device. The device has accessories including alarm, key holder, and flashlight.

2. Description of the Prior Art

Personal protection devices for pedestrians are known in the prior art. Prominent among this group are various forms of batons, which may be employed to strike a human or animal assailant. A device of this sort which acts by projecting an intermediate object rather than by striking the assailant is seen in U.S. Pat. No. 3,125,287, issued to Frederick E. Roehm on Mar. 17, 1964. Roehm's device comprises an axially extensible baton terminating in a disc. When deployed for defensive purposes against a dog, the device is moved longitudinally. This causes a sleeve surrounding the main shaft to move to the fore and aft limits of travel, striking a stop and generating a noise. Hopefully, this noise will dissuade the dog from persisting in its attack. As a fall back, the device is more actively wielded to strike the animal. The disc is caused to strike the dog, which will presumably stun but not injure the dog. This device lacks a member which expands radially when deployed, as occurs in the present invention.

Batons, more popularly known as billy clubs, have long been in use by the police. In subduing belligerent individuals, police batons must generally be wielded by striking the subject person with the baton. While the effectiveness of this instrument may be presumed due to the continuing employment thereof by the police, deployment of a baton requires quite active effort on the part of the user.

Illustrative of police batons are U.S. Pat. Nos. 4,752,072, issued to Kevin L. Parsons on Jun. 21, 1988, and 5,060,123, issued to Charles S. Arnold on Oct. 22, 1991. Both devices have alternative practical uses. The device of Parsons telescopes to increase its effective length, and also incorporates a keyholder. Arnold's baton incorporates a flashlight.

A protective device described in U.S. Pat. No. 5,086,377, issued to Bert Roberts on Feb. 4, 1992, provides a number of protective features, all unlike that of the present invention, and further incorporates a flashlight. The protective features include discharge of an immobilizing substance, and audible and visible alarms.

The batons set forth above are wielded due to their strength, and, like the Roehm device, lack a radially expanding member. Longitudinal expansion is seen in Parsons and Roehm, but radial expansion is not taught in these patents.

None of the above inventions and patents, taken either singly or in combination, is seen to describe the instant invention as claimed.

SUMMARY OF THE INVENTION

The present invention provides personal protection in a specific situation. That is, when a pedestrian is attacked by a dog, he or she wishes to defend himself or herself against injury, but generally wishes to avoid injuring the animal. Thus, it becomes desirable to dissuade the animal from attacking, rather than to counterattack by applying superior force.

This holds true for practical as well as humanitarian reasons. For example, a dog's inclination to attack may be exacerbated if it is struck. Even dispensing an immobilizing substance may cause unintended countereffects should the substance propagate towards the user unexpectedly.

Another aspect of the present invention concerns effort required to deploy the same. A defensive weapon which requires vigorous effort may be too difficult to wield successfully. Therefore, a baton for striking a dog is potentially unsuitable. The present invention provides means for thwarting an animal which offers passive or automatic erection for use, and which operates by intimidating or frustrating the animal, rather than by vigorous clubbing.

To these ends, the erection comprises a tubular holder in which is located a guard in the collapsed state. The guard is spring loaded to extend from the holder and to expand radially when a deployment button is depressed. The guard expands into a generally frustoconical configuration which is held in the dog's face. The dog's face is thus partially surrounded, but the dog is not directly struck or attacked. The partial surrounding may be intimidating or baffling, and it is possible that the animal will retire from the fray.

The holder further summons help from others in the vicinity in the form of audible and visual alarms.

It will be appreciated that a device of this sort is advantageously employed by persons who are walking, running, or otherwise occupied on the public streets among other places, and who are not being conveyed in a motorized vehicle. Persons so engaged will be well served by a device which accommodates needs of one who wishes to handle only one object in his or her travels. Thus, the protective device incorporates certain practical features such as flashlight and key storage. The flashlight enables the user to navigate poorly lit surroundings, and key storage dispenses with the necessity of securing a key on one's person.

Accordingly, it is a principal object of the invention to provide a personal protective device which stymies an animal's attack, but which does not injure or strike the animal.

It is another object of the invention to erect for deployment automatically.

It is a further object of the invention to minimize physical effort of use.

It is an additional object of the invention to partially surround an animal's snout.

It is again an object of the invention to activate sensory alarms when deployed.

Another object of the invention is to incorporate a flashlight in the protective device.

Yet another object of the invention is to provide room for storing keys.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
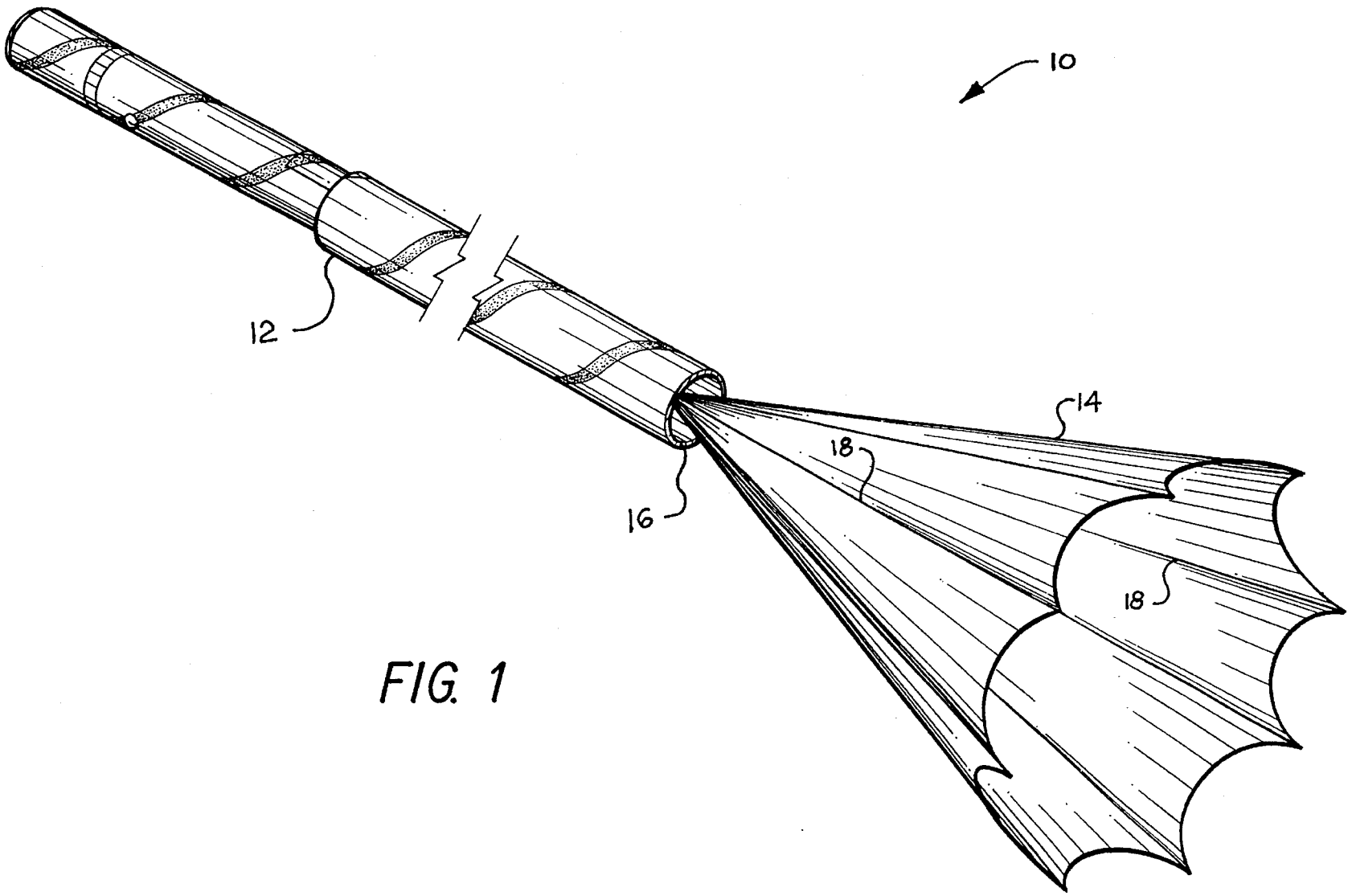
FIG. 1 is a perspective view of the invention in the deployed condition.

AS seen in FIG. 1, the personal protective device 10 of the present invention comprises an elongated, tubular holder 12 and a radially expansible guard 14 which is normally contained within holder 12 when stowed, but for deployment extends axially and outwardly therefrom. When deployed, which condition is illustrated in this Figure, guard 14 extends from an end 16 of holder 12, and expands radially.

Retention of guard 14 within holder 12 and radial expansion are accomplished in the same way that umbrellas (not shown) are stored in the collapsed condition, and are spring biased to expand or become erect. The apparatus for accomplishing this is well known in the umbrella art, and is easily exploited by one of ordinary skill in the art for adaptation to the present invention. It will be appreciated that radial expansion is in the same manner of umbrellas. Depending upon its precise construction, guard 14 may display ribs (not shown) in the manner of a typical umbrella, or may display pleats 18.

Guard 14 opens in a direction opposite that of an umbrella, when comparing holder 12 to the handle of an umbrella. This permits a user to project the erect guard over an, attacking animal's snout, so that the snout is partially surrounded by the guard.

Figure 2:
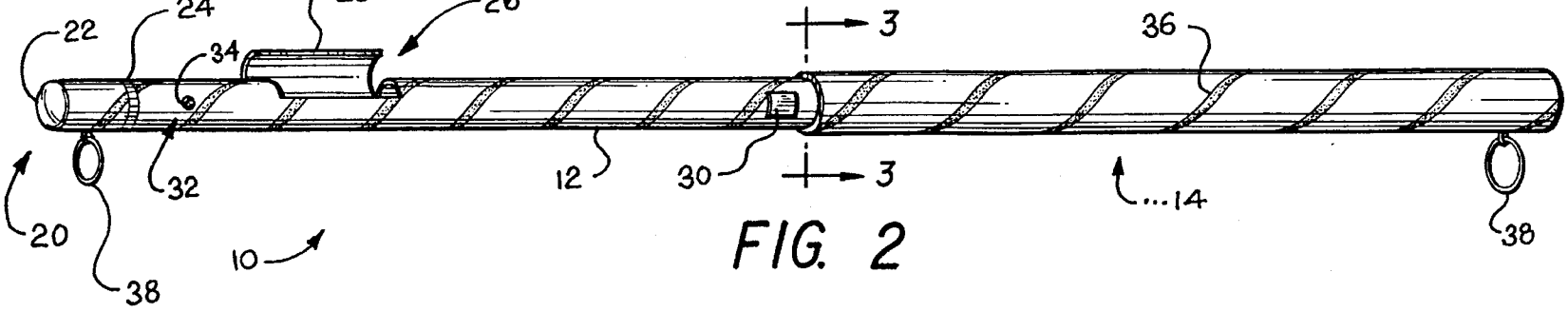
FIG. 2 is a perspective view of the invention in the ready condition, with a storage compartment shown open.

In the stowed condition, as illustrated in FIG. 2, guard 14 is folded and entire contained within holder 12. Holder 12 is larger than required merely for storage of guard 14, and thus provides space for certain ancillary devices.

Flashlight 20 is one such device. The lens 22 of flashlight 20 and a handle 24 of a switch are shown in FIG. 2. The arrangement of handle 24 is preferred since it is both unobtrusive yet highly accessible to the hand of the user. A suitable battery (not shown) is stored within holder 12 and electrically connected in well known fashion to the lamp of flashlight 20.

A second ancillary device comprises a compartment 26 for temporary storage of small objects. Compartment 26 is closed by a small door 28, which is held shut by friction or by any suitable latch (not shown).

A button 30 is provided for releasing guard 14 for deployment. Actuation of the device by depressing button 30 proceeds as is encountered in the case of an umbrella. However, button 30 also is part of any suitable switch (not shown in its entirety) which completes a circuit from the battery which serves flashlight 20 to an audible alarm 32. Audible alarm 32 comprises a suitable miniature sound generator, and sound generated thereby is conducted to the exterior of holder 12 through aperture 34.

Holder 12 also has a fluorescent strip 36 is wound around holder 12 for improving visibility thereof, and two holding rings 38 attached thereto for tethering protective device 10 to an object and to provide another way of grasping device 10.

Figure 3:
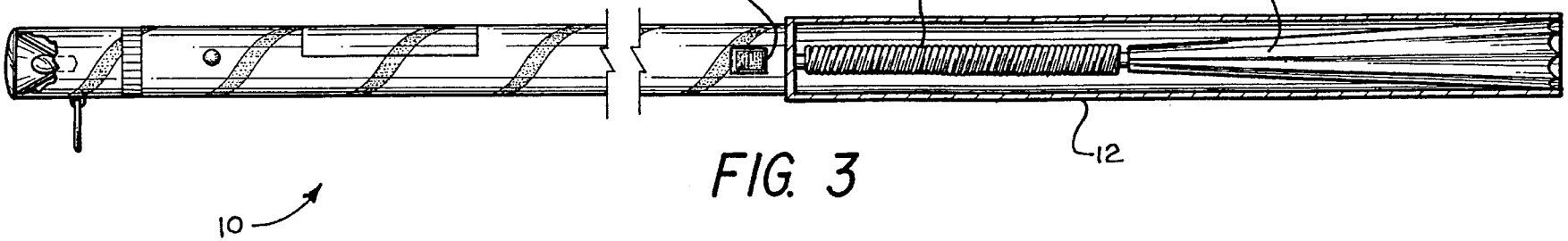
FIG. 3 is a side elevation view of the invention in the ready condition, partially broken away to reveal internal detail, and partially in cross section.

Turning now to FIG. 3, a spring 40 constantly exerts a force urging guard 14 to respond immediately to depression of button 30 by deploying.

Figure 4:
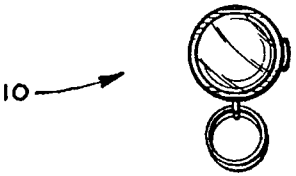
FIG. 4 is an end view of the invention in the ready condition.

FIG. 4 shows an end view of the invention, and emphasizes the compact nature thereof.

It is to be understood that the present invention is not limited to the embodiments described above, but encompasses any and all embodiments within the scope of the following claims.

I claim:

1. A personal protective device for repelling the attack of an animal, comprising:

an elongated holder; and an extensible, radially expansible guard contained within said elongated holder when stowed, and projecting axially from said elongated holder when deployed, whereby an animal's snout is partially surrounded by said radially expansible guard when said personal protective device is wielded.

2. The personal protective device according to claim 1, further comprising a spring contained within said holder urging said radially expansible guard to project from said holder.

3. The personal protective device according to claim 2, further comprising a button located externally upon said holder, said button releasing said radially expansible guard for deployment.

4. The personal protective device according to claim 1, further comprising an audible alarm actuated by said button.

5. The personal protective device according to claim 1, further comprising a holding ring attached to said holder.

6. The personal protective device according to claim 1, further comprising a flashlight lamp and switch for controlling said flashlight lamp.

7. The personal protective device according to claim 1, further comprising means defining a compartment within said holder, for temporary storage of small objects.

8. The personal protective device according to claim 1, further comprising a fluorescent strip of material disposed upon the exterior thereof.

9. The personal protective device according to claim 8, further comprising means defining a compartment within said holder, for temporary storage of small objects.

10. The personal protective device according to claim 8, further comprising a holding ring attached to said holder.

11. A personal protective device for repelling the attack of an animal, comprising:

an elongated holder having a strip of fluorescent material disposed thereon;

an extensible, radially expansible guard contained within said elongated holder when stowed, and projecting axially from said elongated holder when deployed; and a spring contained within said holder urging said radially expansible guard outwardly from said holder, and a button releasing said radially expansible guard to project from said holder, whereby an animal's snout is partially surrounded by said radially expansible guard when said personal protective device is wielded.

12. The personal protective device according to claim 11, further comprising an audible alarm actuated by said button.

13. The personal protective device according to claim 11, further comprising a holder ring attached to said holder.

14. The personal protective device according to claim 11, further comprising a flashlight lamp and switch for controlling said flashlight lamp, said lamp and said switch disposed upon said holder.

15. A personal protective device for repelling the attack of an animal, comprising:

an elongated holder having a holding ring attached thereto and a strip of fluorescent material disposed thereon;

an extensible, radially expansible guard contained within said elongated holder when stowed, and projecting axially from said elongated holder when deployed;

a spring contained within said holder urging said radially expansible guard outwardly from said holder, and a button releasing said radially expansible guard to project from said holder, whereby an animal's snout is partially surrounded by said radially expansible guard when said personal protective device is wielded;

an audible alarm actuated by said button;

a flashlight lamp and switch for controlling said flashlight lamp, said lamp and said switch disposed upon said protective device; and means defining a compartment within said holder, for temporary storage of small objects.

* * * * *